US007325585B1

(12) United States Patent
Benetti

(10) Patent No.: US 7,325,585 B1
(45) Date of Patent: Feb. 5, 2008

(54) DENTAL PROSTHETIC FORMING SYSTEM

(76) Inventor: Giulio Benetti, 25243 N. 40th La., Glendale, AZ (US) 85310

( * ) Notice: Subject to any disclaimer, the term of this patent is extended or adjusted under 35 U.S.C. 154(b) by 0 days.

(21) Appl. No.: 11/439,327

(22) Filed: May 23, 2006

(51) Int. Cl.
*B22C 9/04* (2006.01)
*B22C 9/08* (2006.01)

(52) U.S. Cl. ..... 164/34; 35/516; 35/359

(58) Field of Classification Search ..... 164/34–36, 164/516–519, 359–360
See application file for complete search history.

(56) References Cited

U.S. PATENT DOCUMENTS 4,676,294 A * 6/1987 Berger ..... 164/35
4,682,644 A * 7/1987 Ueno ..... 164/359
4,741,378 A 5/1988 Engelman et al.
4,972,897 A * 11/1990 Thomas ..... 164/35
6,886,986 B1 * 5/2005 Julien ..... 384/492

* cited by examiner

*Primary Examiner*—Kuang Lin
(74) *Attorney, Agent, or Firm*—Thomas R. Lampe

(57) ABSTRACT

A system for forming a dental prosthetic using the lost wax method utilizes a unitary pattern assembly to create a unitary cavity in a mold incorporating a dental prosthetic pattern cavity portion, a reservoir cavity portion and at least one sprue. The volume of the reservoir cavity portion is greater than the volume of the dental prosthetic pattern cavity portion.

9 Claims, 3 Drawing Sheets

DENTAL PROSTHETIC FORMING SYSTEM

TECHNICAL FIELD

This invention relates to a method and a unitary pattern assembly for casting dental prosthetics, such as crowns, bridges, single units and the like, using the lost wax process.

BACKGROUND OF THE INVENTION

The lost wax method is a well known process for producing castings of many types. The lost wax method is commonly used to create castings for dental prosthetics.

As noted in U.S. Pat. No. 4,741,378, issued May 8, 1988, the production of cast dental restorations and prosthetics involves the production of a wax pattern configured to match the desired restoration. This pattern is attached to a support commonly known as a sprue and the sprue is, in turn, secured to a base member.

The sprue, base member and wax pattern are placed within the container which is thereafter filled with investment. After the investment has hardened, it is heated in order to melt the sprue and wax pattern, the melted wax flowing out of the investment through an opening created by the sprue and base, thereby leaving a passage and cavity within the investment.

Molten alloys are then directed through the passageway created by the sprue and into the casting cavity created by the wax pattern. A centrifuge is customarily used to promote flow. As the alloy solidifies, a casting is produced which is essentially a duplicate of the original wax pattern.

As further noted in U.S. Pat. No. 4,741,378, a variety of sprue assemblies have been developed. However, they have a number of drawbacks. One problem encountered relates to the shrinkage of the alloy as it cools. When the molten alloy filling the casting cavity cools, shrinkage occurs. In order to avoid irregularities in the final casting, there needs to be a source of molten alloy which can be drawn into the pattern cavity as the contents cool. To provide this source of molten alloy, sprue pins were formed with a bulbous area at a point toward the tip so as to create a reservoir of molten alloy within the investment. This reservoir is very small and does not provide a large amount of molten alloy. The primary reservoir for molten alloy lies outside the mold.

The sprue pin of U.S. Pat. No. 4,741,378 was devised to improve the performance of prior art sprue pins, more particularly by use of a hollow sprue pin having a bulbous extension about it wherein the end of the sprue pin which attaches to the wax pattern gradually decreases in external circumference toward the tip. It is indicated that such an arrangement prevents formation of blockages between the cavity and the relatively small reservoir provided by the sprue pin.

One of the problems inherent in prior art arrangements is waste of metal alloy used to form the casting. These alloys often incorporate precious metals. Principally, but not exclusively, this problem is a result of the use of externally disposed "buttons" or reservoirs of alloy material during the casting operation. These cool relatively quickly and material can stick to the mold, producing blockages and otherwise interfere with proper casting.

As will be seen below, the system of the present invention utilizes a relatively large internal reservoir within the confines of the investment. This not only reduces waste and saves labor, the arrangement produces a casting which is well defined, accurate and free of internal voids or other defects. Placement of the alloy reservoir within the confines of the investment enables the alloy therein to remain molten for a long period of time, promoting replenishment of the alloy in the dental prosthetic casting to be supplemented during cooling thereof over that long period of time. There is no shrinkage, porosity or "suck back." This results in a superior casting. The invention may be used to produce dental prosthetic castings of virtually any shape and size.

DISCLOSURE OF INVENTION

The method of forming a dental prosthetic of the present invention includes the step of forming a unitary cavity in a mold of investment, the unitary cavity incorporating a dental prosthetic pattern cavity portion, a reservoir cavity portion and at least one sprue leading from the reservoir cavity portion to the dental prosthetic pattern cavity portion, the unitary cavity being wholly disposed within the investment.

A molten casting alloy is introduced into the reservoir cavity portion.

The molten casting alloy flows from the reservoir cavity portion through the at least one sprue into the dental prosthetic pattern cavity portion, the amount of molten casting alloy introduced into the reservoir cavity being sufficient to completely fill the dental prosthetic pattern cavity portion and the at least one sprue and at least partially fill the reservoir cavity portion. A sufficient amount of molten casting alloy will be contained in the reservoir cavity portion within the confines of the investment to be drawn into the dental prosthetic pattern cavity portion through the at least one sprue due to cooling of the molten casting alloy in the dental prosthetic pattern cavity portion.

The volume of the reservoir cavity portion is formed larger than the volume of the dental prosthetic pattern cavity portion.

The invention also encompasses a unitary pattern assembly of unique character for use in forming a unitary cavity in a mold formed of investment. The unitary pattern assembly includes a first pattern member formed of wax or plastic having a base and a reservoir pattern.

The pattern assembly also incorporates a second pattern member formed of wax or plastic including a dental prosthetic pattern and at least one sprue.

The first and second pattern members are attached together with the dental prosthetic pattern and the reservoir pattern being spaced from one another and interconnected by the at least one sprue. The volume of the reservoir pattern is greater than the volume of the dental prosthetic pattern.

Other features, advantages and objects of the present invention will become apparent with reference to the following description and accompanying drawings.

MODES FOR CARRYING OUT THE INVENTION

Figure 1:
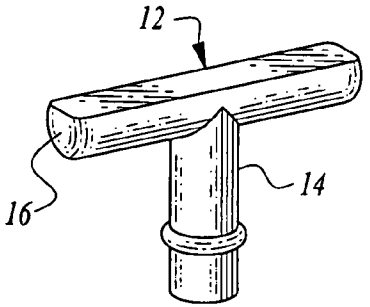
FIG. 1 is a perspective view of a pattern member of the unitary pattern assembly of the invention incorporating a base and reservoir pattern.
Figure 2:
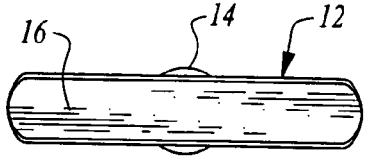
FIG. 2 is a top, plan view of the pattern member of FIG. 1.
Figure 3:
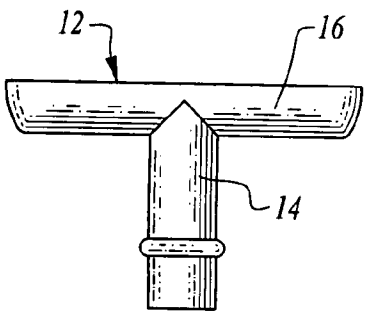
FIG. 3 is a front, elevational view of the pattern member of FIG. 1.

Referring now to FIGS. 1-3 and 7-15, according to the teachings of the present invention, a unitary pattern assembly 10 is illustrated (FIGS. 8-10) and designated by reference numeral 10. The assembly is for use in forming a unitary cavity in a mold formed of investment.

The unitary pattern assembly includes a pattern member 12 formed of wax or plastic including a base 14 and a reservoir pattern 16.

Unitary pattern assembly 10 includes a second pattern member 18 also formed of wax or plastic. Pattern member 18 includes a dental prosthetic pattern 20 (in this instance an assembly of four crowns) and four sprues 22 and a sprue bar 24. The combined volume of the sprue bar and reservoir pattern 16 is greater than the volume of the dental prosthetic pattern and sprues.

Figure 8:
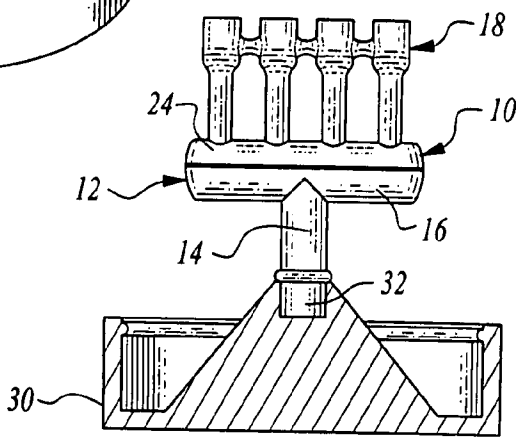
FIG. 8 is a front, elevational view showing the two pattern members connected together and the base positioned in an opening or hole of the container end cap.

The two pattern members 12, 18 are connected together as shown in FIG. 8 to form the unitary pattern assembly 10. Various means may be employed to accomplish this, including coating the pattern members with wax.

Figures 9, 10, 11:
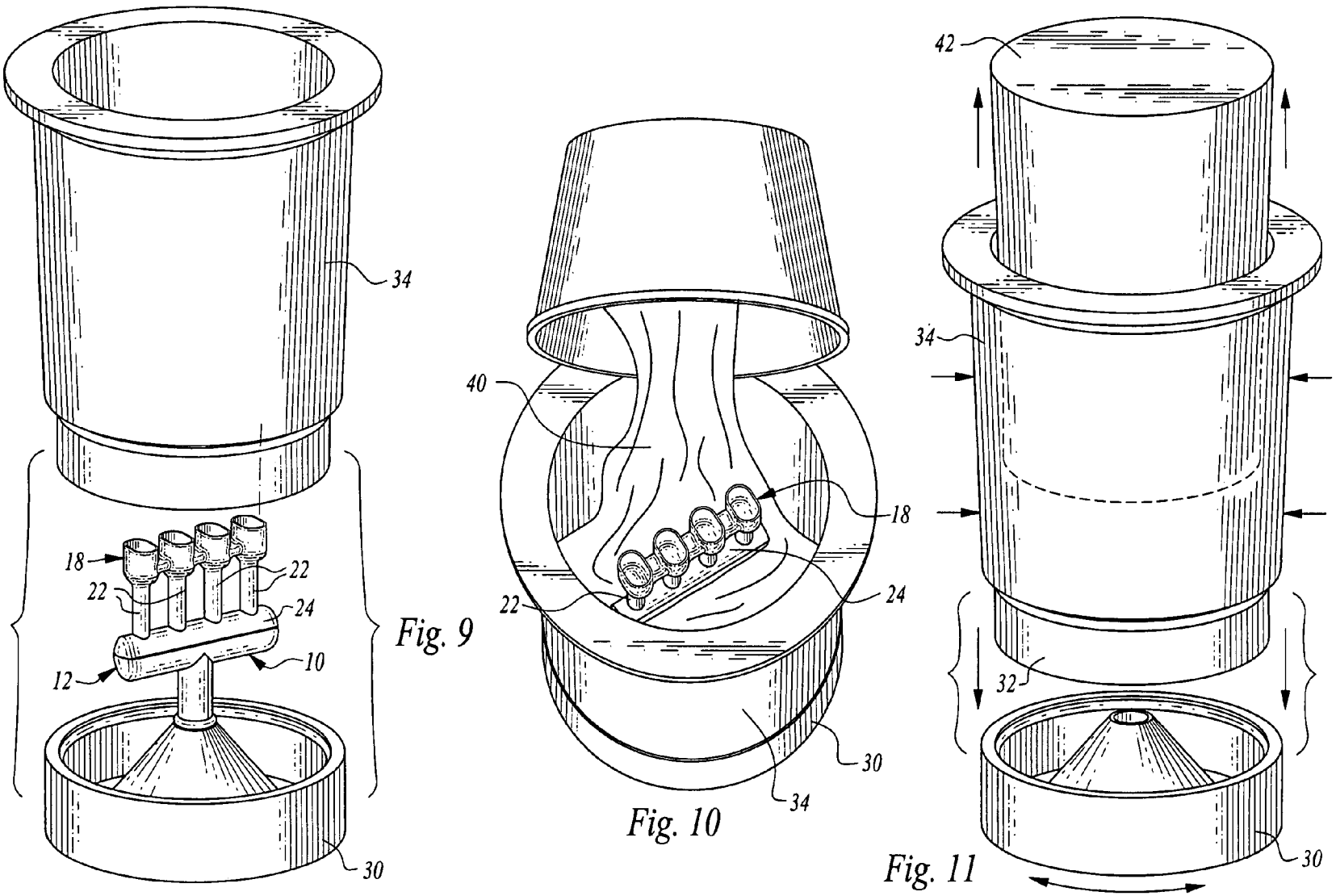
FIG. 9 shows the end cap being applied to a container body to position the unitary pattern assembly within the interior thereof.
FIG. 10 shows investment being poured into the interior of the container to completely cover the unitary pattern assembly.
FIG. 11 is a perspective view showing the mold being removed from the container after hardening thereof.

The unitary pattern assembly is held by a container end or cap 30, as shown in FIG. 8, more particularly the base 14 of pattern member 18 is inserted in an end hole or recess 32. The cap 30 is then attached to the bottom of a generally cylindrical container portion 34 (FIGS. 9-11). This positions the unitary pattern assembly 10 within the interior of the container with the base positioning the reservoir pattern inwardly of the cap.

Next, investment 40 is poured into the container interior as shown in FIG. 10. Sufficient investment is poured into the container to cover the reservoir pattern and the pattern member 18.

Figure 14:
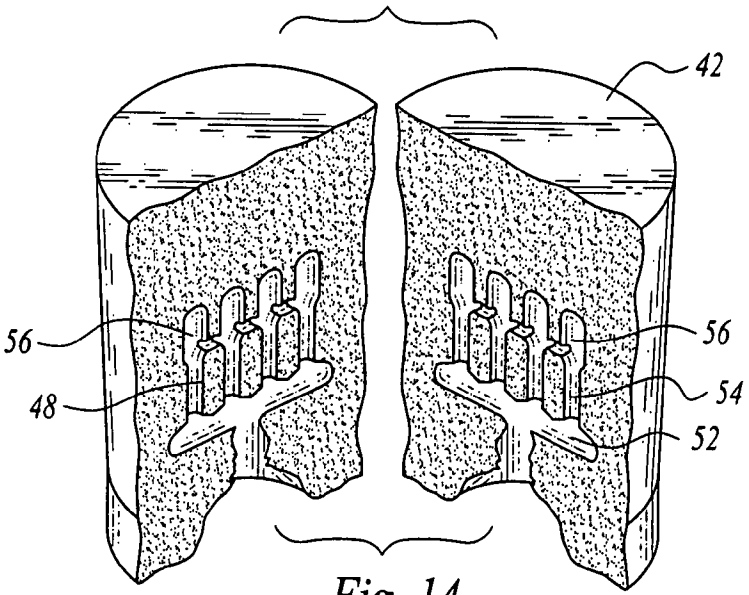
FIG. 14 is a perspective view showing the cavity broken away to illustrate cavity configuration after casting removal.

After the investment has hardened, the mold 42 comprising the investment is removed from the container as shown in FIG. 11. The mold is heated to melt the pattern members 12, 18 and form a unitary cavity 48 as shown in FIGS. 12-14.

Figure 12:
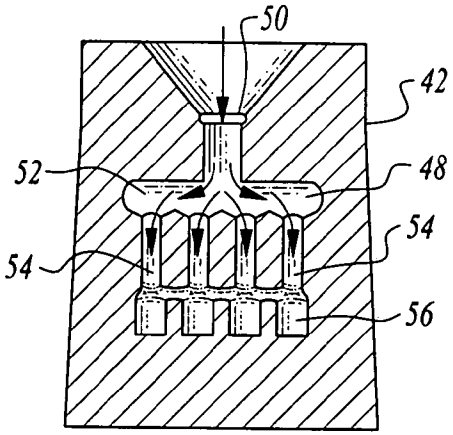
FIG. 12 is an elevational, cross-sectional view of the mold and illustrating diagrammatically by arrows the flow path of molten alloy when introduced into the unitary cavity of the mold, as for example by a centrifuge.
Figure 13:
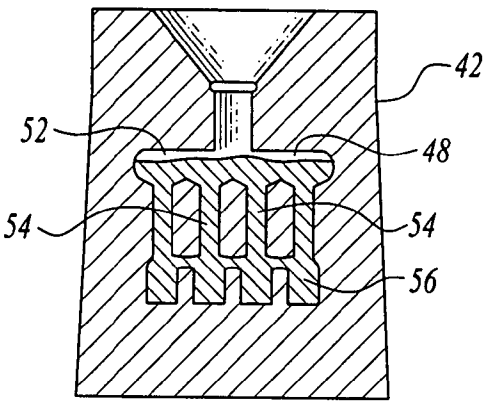
FIG. 13 is view similar to FIG. 12, but illustrating alloy in the unitary cavity.

FIG. 12 designates by arrows the flow of molten casting alloy into the unitary cavity 48. The alloy in its molten state passes through an upper opening 50 into reservoir cavity portion 52 and thence through cavity sprues 54 into the dental prosthetic pattern cavity portion 56. This is normally accomplished by a centrifuge (not shown).

The amount of molten casting alloy introduced into the reservoir cavity portion produced by melting of the combined sprue bar and reservoir is sufficient to completely fill the dental prosthetic pattern cavity portion and sprues 54. This continues until the reservoir cavity portion 52 is at least partially filled and until a sufficient amount of molten casting alloy is contained in the reservoir cavity portion within the confines of the investment to be drawn into the dental prosthetic pattern cavity portion through the sprues due to cooling of the molten casting alloy in the dental prosthetic pattern cavity portion.

The volume of the reservoir cavity portion is formed larger than the combined volumes of the dental prosthetic pattern cavity portion and the sprues.

Figure 15:
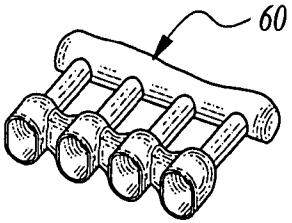
FIG. 15 is a perspective view of the casting produced in the mold.

FIG. 15 shows a casting 60 produced by the unitary cavity 48 of mold 42.

Figure 4:
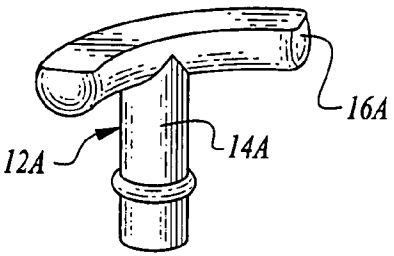
FIG. 4 is a perspective view of an alternative form of pattern member including a base and reservoir pattern.
Figure 5:
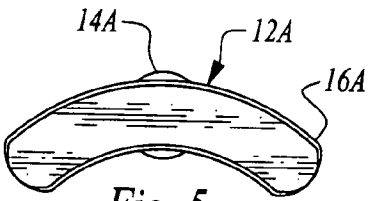
FIG. 5 is a top, plan view of the pattern member of FIG. 4.
Figure 6:
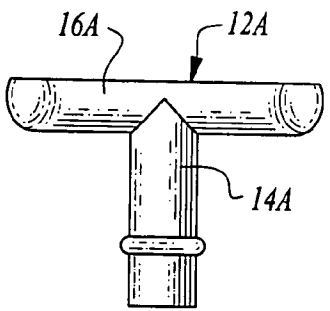
FIG. 6 is a front, elevational view of the pattern member of FIG. 4.
Figure 7:
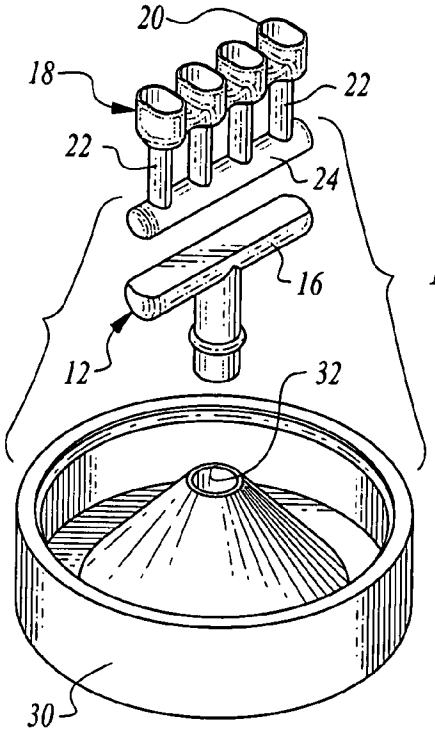
FIG. 7 is an exploded, perspective view illustrating the pattern member of FIGS. 1-3 prior to insertion of the base thereof into an end cap of a container and prior to attachment of a pattern member including a dental prosthetic pattern and a plurality of sprues to the pattern member incorporating the base and reservoir pattern.
Figure 16:
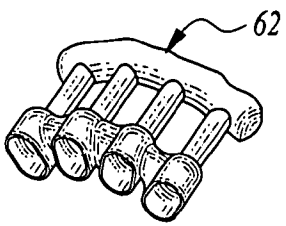
FIG. 16 is a view similar to FIG. 15, but illustrating the casting produced when using the embodiment of the pattern member shown in FIGS. 4-6.

FIG. 16 shows an alternative form of casting 62 which is produced when one employs the pattern member 12A shown in FIGS. 4-6 in conjunction with a similarly curved second pattern member (not shown). It will be appreciated that the principles of the present invention can be utilized to provide dental prosthetic castings of virtually any shape, type and size and that a wide variety of molten alloys may be utilized in the casting. The invention can be used not only for fabrication of multiple crowns and bridges but single units as well.

The castings produced are accurate in dimension, nonporous, easy to clean and free of "suck back." Utilizing the teachings of the present invention, less metal or alloy is utilized then when using prior art approaches. There is virtually no waste.

The invention claimed is:

1. A method of forming a dental prosthetic by direct casting, said method comprising the steps of:

forming a unitary cavity in a mold of investment, said unitary cavity incorporating a dental prosthetic pattern cavity portion, a double-ended elongated reservoir cavity portion and at least one sprue leading from said elongated reservoir cavity portion to said dental prosthetic pattern cavity portion, said unitary cavity being wholly disposed within said investment, and said mold of investment defining a substantially straight passageway substantially orthogonally disposed relative to said elongated reservoir cavity portion directly leading from the elongated reservoir cavity portion from a location between the ends thereof to the exterior of said mold investment, said unitary cavity being completely surrounded by said investment except at said substantially straight passageway;

introducing an amount of molten casting alloy into said elongated reservoir cavity portion through said substantially straight passageway directly to said elongated reservoir cavity portion;

causing said molten casting alloy introduced into said elongated reservoir cavity portion to flow from said elongated reservoir cavity portion through said at least one sprue into said dental prosthetic pattern cavity portion, the amount of molten casting alloy introduced into said elongated reservoir cavity portion being sufficient to completely fill said dental prosthetic pattern cavity portion and said at least one sprue and partially fill said elongated reservoir cavity portion whereby a sufficient amount of molten casting alloy will be contained in said elongated reservoir cavity portion within the confines of said investment to be drawn into said dental prosthetic pattern cavity portion through said at least one sprue due to cooling of said molten casting alloy in said dental prosthetic pattern cavity, and said amount of molten casting alloy introduced into said elongated reservoir cavity portion being insufficient to completely fill said elongated reservoir cavity portion after said molten casting alloy fills said dental prosthetic pattern cavity portion and said at least one sprue whereby said molten casting alloy remaining in said elongated reservoir cavity portion during drawing of the molten casting alloy into the prosthetic pattern cavity portion does not reach said substantially straight passageway and will not be drawn into said substantially straight passageway upon cooling of said molten casting alloy; and employing said investment to insulate and delay cooling of said molten casting alloy in said elongated reservoir cavity portion to promote replenishment of the molten casting alloy in the dental prosthetic pattern cavity portion and at least one sprue from molten casting alloy solely from said elongated reservoir cavity portion to produce a well defined, accurate dental prosthetic substantially free of internal voids.

2. The method according to claim 1 wherein said dental prosthetic pattern cavity portion is elongated, with said elongated reservoir cavity portion spaced from and extending lengthwise along said dental prosthetic pattern cavity portion, a plurality of spaced sprues being disposed between and interconnecting said dental prosthetic pattern cavity portion and said elongated reservoir cavity portion.

3. The method according to claim 1 wherein said molten casting alloy is introduced into said elongated reservoir cavity portion from said substantially straight passageway through an opening spaced from said at least one sprue and connected with said elongated reservoir cavity portion generally mid-way along the length thereof.

4. The method according to claim 1 wherein during the step of forming a unitary cavity, the volume of said reservoir cavity portion is formed larger than the volume of said dental prosthetic pattern cavity portion.

5. The method according to claim 1 wherein during the step of forming a unitary cavity, the volume of said reservoir cavity portion is formed larger than the combined volumes of said dental prosthetic pattern cavity portion and said at least one sprue.

6. The method according to claim 1 wherein the step of forming a unitary cavity in said mold comprises forming a first pattern member formed of plastic and including a substantially straight, elongated base for forming said substantially straight passageway and an elongated reservoir pattern for forming said elongated reservoir cavity portion, forming a second pattern member formed of wax and including a dental prosthetic pattern and at least one sprue, attaching said first pattern member and said second pattern member to form a unitary pattern assembly, placing said unitary pattern assembly in a container, while said unitary pattern assembly is in said container filling said container with investment in sufficient quantity to cover said elongated reservoir pattern and said second pattern member, and after hardening of said investment heating said investment to melt said first and second pattern members to form said unitary cavity.

7. The method according to claim 6 wherein said at least one sprue includes an elongated sprue bar attached to the elongated reservoir pattern of said first pattern member during said step of attaching said first and second pattern members, and said elongated sprue bar being positioned to extend along said elongated reservoir pattern.

8. The method according to claim 7 wherein said first and second pattern members are attached together by coating said first and second pattern members with wax.

9. The method according to claim 6 wherein said container includes a container end defining an end opening, said base of said first pattern member being positioned in said end opening with said reservoir pattern being spaced from said container end prior to placing said pattern assembly in the container.

* * * * *